US008403056B2

(12) United States Patent
Gette et al.

(10) Patent No.: US 8,403,056 B2
(45) Date of Patent: Mar. 26, 2013

(54) DRILL PIPE RUNNING TOOL

(75) Inventors: Nicholas Gette, Houston, TX (US); Guilherme Pedro Eppinghaus, Rio de Janiero (BR)

(73) Assignee: Vetco Gray Inc., Houston, TX (US)

( * ) Notice: Subject to any disclaimer, the term of this patent is extended or adjusted under 35 U.S.C. 154(b) by 371 days.

(21) Appl. No.: 12/846,347

(22) Filed: Jul. 29, 2010

(65) Prior Publication Data

US 2012/0024541 A1 Feb. 2, 2012

(51) Int. Cl.
*E21B 33/03* (2006.01)

(52) U.S. Cl. ..... 166/348; 166/382; 166/208

(58) Field of Classification Search ..... 166/348, 166/382, 182, 208
See application file for complete search history.

(56) References Cited

U.S. PATENT DOCUMENTS

| | | | | |
|---|---|---|---|---|
| 4,616,987 | A | 10/1986 | Boyers et al. | |
| 4,770,248 | A * | 9/1988 | Houlgrave et al. | 166/341 |
| 4,880,061 | A * | 11/1989 | Ahlstone | 166/348 |
| 4,969,516 | A | 11/1990 | Henderson | |
| 5,249,629 | A | 10/1993 | Jennings | |
| 5,372,201 | A | 12/1994 | Milberger | |
| 5,655,606 | A | 8/1997 | Ferguson | |
| 6,719,044 | B2 | 4/2004 | Ford | |
| 6,823,938 | B1 | 11/2004 | Milberger | |
| 7,743,832 | B2 | 6/2010 | Shaw | |
| 2009/0195647 | A1 | 8/2009 | Lynde | |
| 2010/0212890 | A1 | 8/2010 | Lund | |

OTHER PUBLICATIONS

Search Report from corresponding GB Application No. GB1112556.4 dated Oct. 25, 2011.

* cited by examiner

*Primary Examiner* — William P Neuder
(74) *Attorney, Agent, or Firm* — Bracewell & Giuliani LLP

(57) ABSTRACT

A system and method for verifying support hanger orientation within a wellhead housing. In an example, a profile is included at a designated location on an inner surface of the wellhead housing. When the support hanger is landed in the wellhead housing, an impression is taken of the inner surface of the wellhead housing from a reference location. Analyzing the impression can indicate the position of the support hanger within the wellhead housing. A running tool that can land the support hanger within the wellhead housing can be equipped with an impression block for taking the impression of the profile in the wellhead housing.

23 Claims, 6 Drawing Sheets

DRILL PIPE RUNNING TOOL

FIELD OF THE INVENTION

This invention relates in general to completion of oil and gas wells, and in particular to a system and method for estimating orientation of a casing hanger in a wellhead housing.

DESCRIPTION OF RELATED ART

Wellheads used in the production of hydrocarbons extracted from subterranean formations typically comprise a wellhead assembly attached at the upper end of a wellbore formed into a hydrocarbon producing formation. An annular wellhead housing typically makes up the outermost member where wellhead assemblies connect to a wellbore. A production tree usually connects to the upper end of a wellhead assembly for controlling flow in and out of the wellbore and allowing access into the wellbore. Support hangers are generally included within the wellhead housing for suspending production tubing and casing into the wellbore. The casing lines the wellbore, thereby isolating the wellbore from the surrounding formation. The tubing typically lies concentric within the casing and provides a conduit therein for producing the hydrocarbons entrained within the formation.

When assembling a wellhead assembly subsea, a running tool is often employed for lowering the components of the wellhead to the seafloor, such as wellhead housings and support hangers. The running tool is generally deployed from a rig and suspended from drilling pipe. After anchoring the wellhead housing to the seafloor, the support hanger is then typically lowered and inserted within the wellhead housing the running tool. After landing the support hangers, the running tool may deploy a seal between the support hanger and wellhead housing. The running tool can then be removed from the wellbore and the seal pressure tested. In some instances, if the support hanger is not landed in the wellhead housing at a specified axial location, the annular space between the support hanger and wellhead housing cannot be properly sealed. A misaligned support hanger can be corrected, but requires redeploying the running tool into the well after the step of pressure testing.

The running tool is typically powered by pressurized fluid pumped down the drill string from the surface. Prior to pressurizing the string, a ball or dart is dropped down inside the drill string and lands in a dart sub or ball sub set below the running tool. This allows pressure to build up inside the stem of the tool that is ported through drilled holes to a piston that drives the energizing ring into the seal.

SUMMARY OF THE INVENTION

The present disclosure concerns a system and method for verifying positioning of a support hanger within a wellhead housing. Described herein is a running tool for inserting a support hanger into a wellhead housing that has a profiled inner surface. In an example embodiment, the running tool includes a body, a support hanger deployment device coupled with the body and selectively attached to the support hanger, and an impression assembly that is strategically located at a designated position with respect to the support hanger. In an example embodiment the impression assembly includes a member selectively moveable from a retracted position that is substantially within the body, to an extended position where it projects radially outward from the body towards the wellhead housing inner surface. A deformable impression element is included on an end of the member, so that when the member is moved into the extended position, the impression element is pressed against the wellhead housing inner surface and an impression of the wellhead housing inner surface is on the impression element. The support hanger can be a casing hanger, a tubing hanger, or a bridging hanger. Strategically positioning the impression assembly places the impression assembly in a location so that the impression is of the profiled inner surface of the wellhead housing when the support hanger is set at a designated depth within the wellhead housing.

DETAILED DESCRIPTION OF THE INVENTION

Figure 1:
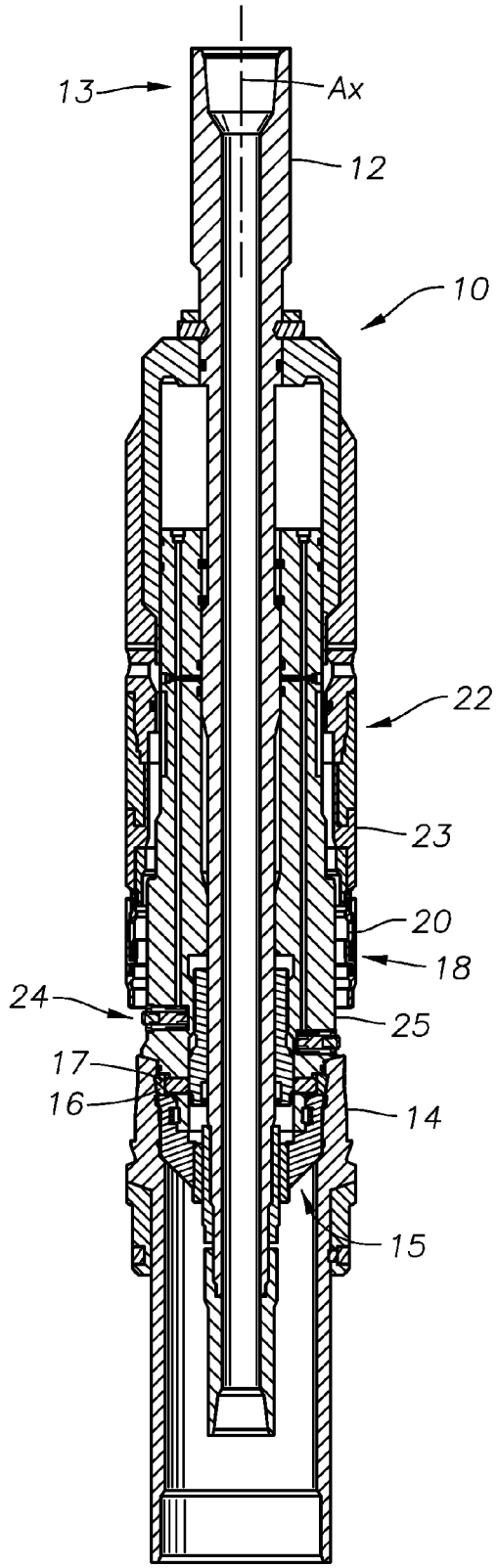
FIG. 1 is a side sectional view of an example embodiment of a running tool as disclosed herein.

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation. Accordingly, the subject disclosure is therefore to be limited only by the scope of the appended claims.

An example embodiment of a running tool 10 in accordance with the present disclosure is shown in a side sectional view in FIG. 1. The running tool 10 is shown haying an annular mandrel 12 provided substantially along an axis $A_X$ of the running tool 10. A connector 13 is provided at the upper end of the mandrel 12 for connection to a means for raising, lowering, and control/operation of the running tool 10, such as drill pipe (not shown). At least one use of the running tool 10 is for delivering and landing support hangers, such as a casing, bridging, and/or tubing hanger, within wellhead housings. In the example of FIG. 1, the support hanger is a casing hanger 14, and is shown coupled to a deployment mechanism 15 on the running tool 10. The deployment mechanism 15 is mounted on the mandrel 12 includes a dog 16 shown outwardly biased into engagement with a profile 17 on an inner circumference of the casing hanger 14. Inwardly retracting the dog 16 selectively uncouples from the casing hanger 14 after landing the casing hanger 14 within a wellhead housing (not shown). The running tool 10 also delivers a seal assembly 18 in the wellhead housing that is shown disposed coaxial about the running tool 10 and above the casing hanger 14. An annular energizing ring 20 is coupled to the lower end of a ram assembly 22 provided with the running tool 10. An insertion ram 23 is provided with the ram assembly 22 that when hydraulically stroked forces the energizing ring 20 into the seal assembly 18.

Figure 2:
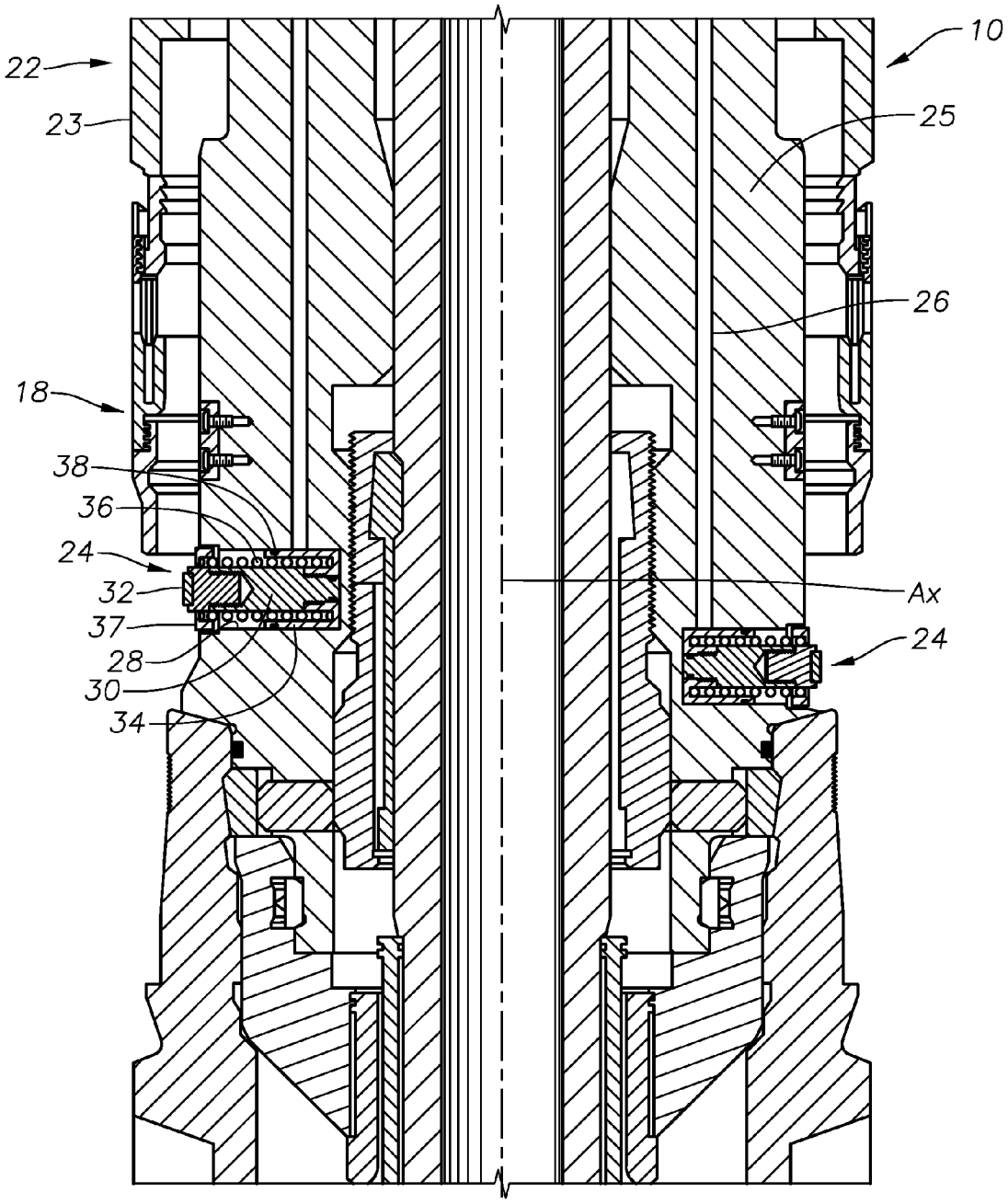
FIG. 2 is a side sectional view detail of a portion of the tool of FIG. 1.

Still referring to FIG. 1, the running tool 10 also includes a cylindrical body 25 that circumscribes a portion of the mandrel 12. A lead block assembly 24 is shown mounted within the body 25. Referring now to FIG. 2, an enlarged view of the portion of the running tool 10 having the lead block assembly 24 is shown in a side sectional view. A hydraulic line 26 shown in the body 25 connects to a cylindrical bore 28 that forms the outer surface of a portion of the lead block assembly 24. The bore 28 is generally elongate with a closed end set within the body 25 and an open end opposite the closed end and on a portion of the bore 28 that projects radially out from running tool axis $A_X$.

Set coaxially within the bore 28 is a generally cylindrical impression rod or member 30 and having a portion projecting through the open end of the bore 28. A lead element 32 is shown provided on the end of the impression rod 30 outside of the bore 28. The lead element 32 can be formed of any substantially malleable material, such as a soft metal, including lead. The impression rod 30 abruptly narrows on the end opposite the lead element 32 where it threadingly attaches to a piston 34. The outer surface of the piston 34 is substantially cylindrical and formed to sealingly engage the inner circumference of the bore 28 and freely reciprocate therein. A closed end is provided in the piston 34 where its outer surface projects radially inward proximate the closed end of the bore 28 and then extends axially outward away from the closed end of the bore 28. The piston 34 of FIG. 2 is open on the end opposite its closed end. A receptacle is formed where the piston 34 extends axially away from the closed end of the bore 28 that receives the threaded end of the impression rod 30.

An annular space is provided lengthwise in the piston 34 that runs from the closed end and to the open end of the piston 34. A spring 36 is shown set within the annular space retained between the closed end of the piston 34 and a lip 37 that projects radially inward into the open side of the bore 28. As shown, the spring 36 exerts a biasing force on the piston 34 to retain the lead block assembly 24 within the bore 28. A seal 38 is shown circumscribing the outer surface of the piston 34 thereby providing a seal between the piston 34 and inner surface of the bore 28. In the embodiment of FIG. 2, an optional additional lead block assembly 24 is shown lower in the body 25 and just above a rim of the casing hanger 14.

Figure 3:
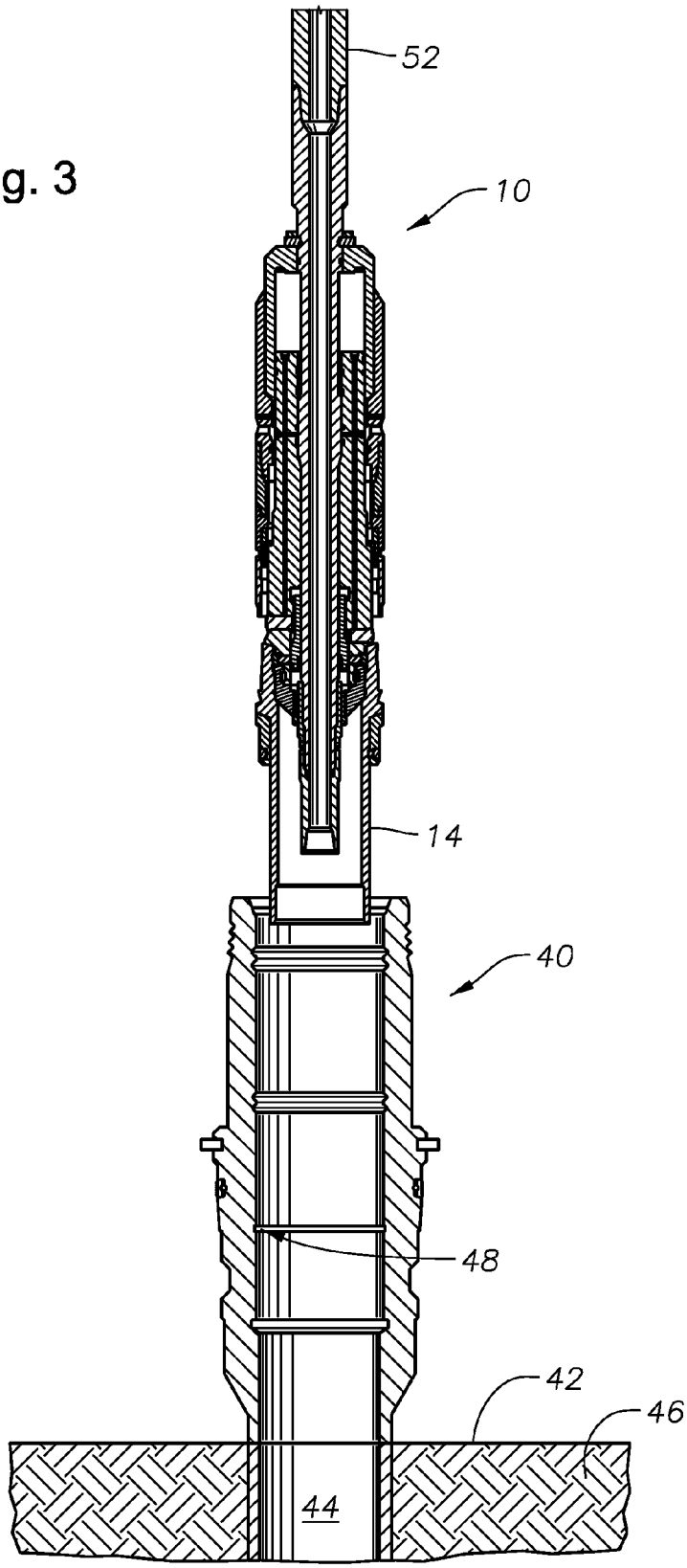
FIG. 3 is a side sectional view of the running tool of FIG. 1 being inserted into a wellhead housing.

FIG. 3 illustrates in a side sectional view an example of the running tool 10 of FIG. 1 being inserted within a wellhead housing 40 for landing the casing hanger 14 within the wellhead housing 40. The wellhead housing 40, which may be subsea, is shown set coaxially above a well bore 44 formed through a subterranean formation 46. The wellhead housing 40 of FIG. 3 includes a profiled inner surface, a portion of which includes a groove 48 shown circumferentially formed along the inner surface of the wellhead housing 40. Though a single groove 40 is illustrated and having a rectangular cross section, other forms of grooves are included within the present disclosure, such as multiple grooves, curved cross sectional grooves, and grooves that vary in axial location within the wellhead housing with respect to angular location within the wellhead housing 40.

Figure 4:
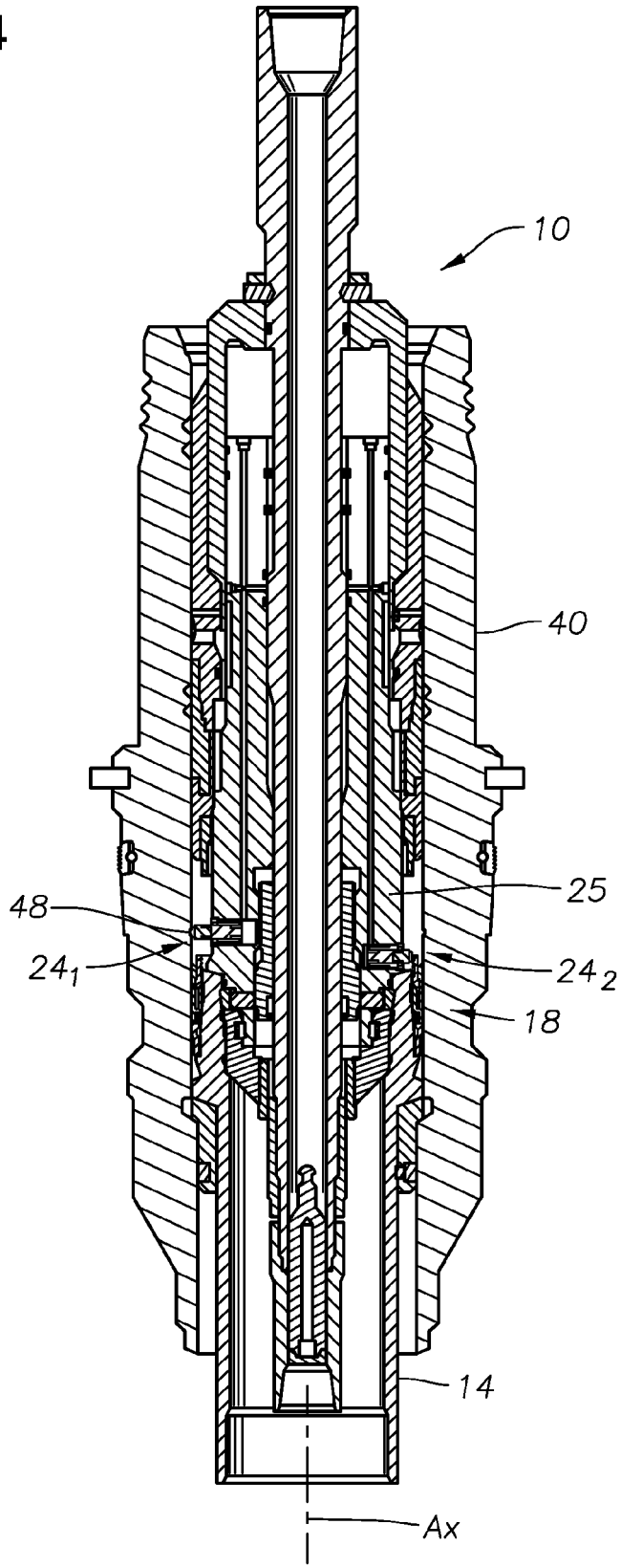
FIG. 4 is a side sectional view of the running tool of FIG. 1 inserted into the wellhead housing of FIG. 3.

Referring now to FIG. 4, the running tool 10 is shown inserted coaxially within the wellhead housing 40. While within the wellhead housing 40, the casing hanger 14 may be decoupled from the running tool 10 and landed within the wellhead housing 40. In the example embodiment of FIG. 4, two lead block assemblies $\mathbf{24}_1$, $\mathbf{24}_2$ are illustrated set within the body 25 of the running tool 10. Lead block assembly $\mathbf{24}_1$ is shown substantially aligned with the groove 48 whereas block assembly $\mathbf{24}_2$ is at an axial distance below the groove 48. Thus by knowing respective axial distances between the casing hanger 14, lead block assemblies $\mathbf{24}_1$, $\mathbf{24}_2$, and groove 48, the axial location of the casing hanger 14 within the wellhead housing 40 can be determined based upon an analysis of an impression taken by one or both of the lead block assemblies $\mathbf{24}_1$, $\mathbf{24}_2$. The precision of the determination can be adjusted based upon the number of lead block assemblies $\mathbf{24}_N$ used with the running tool 10.

Figure 5:
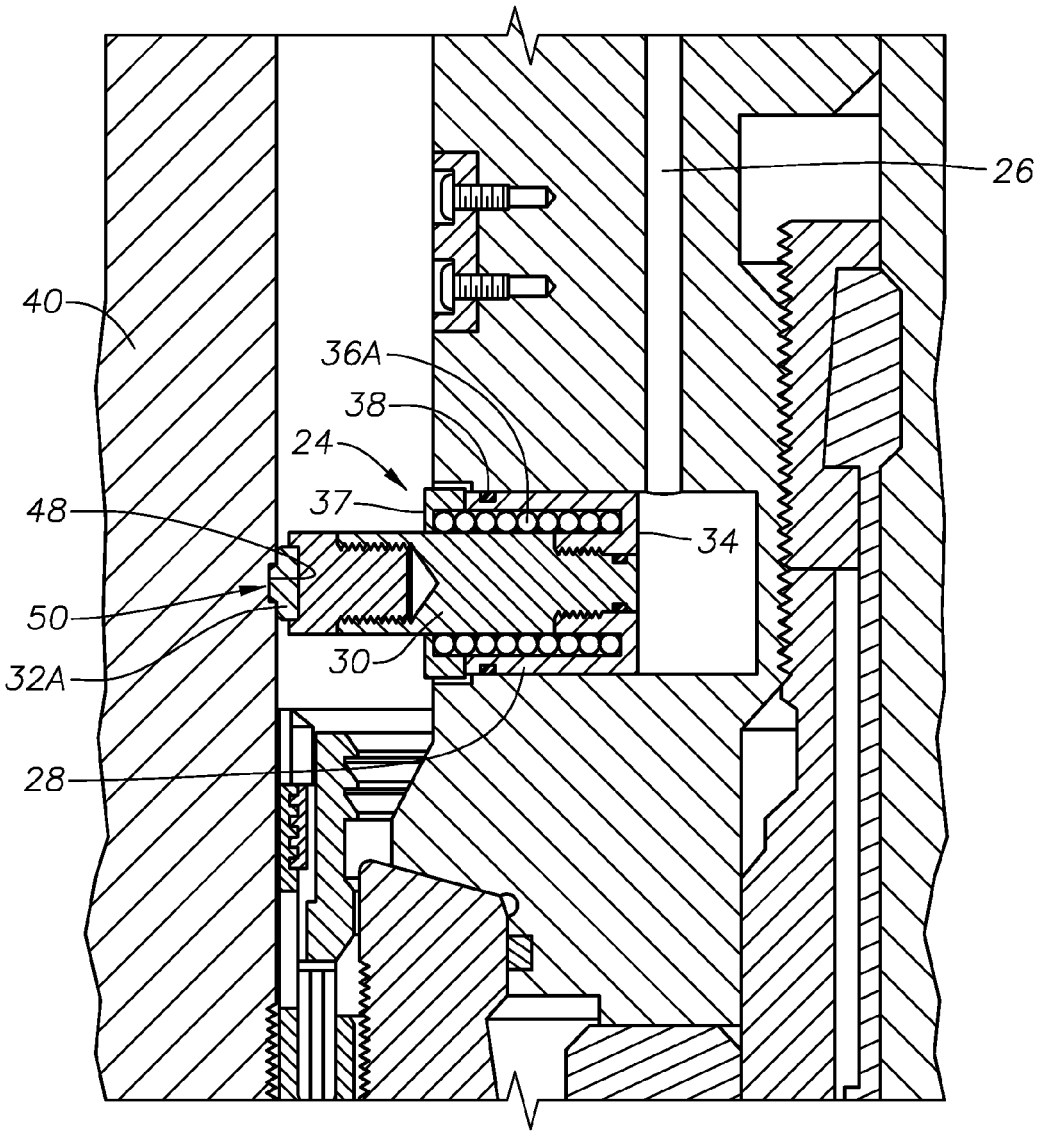
FIG. 5 is a side sectional view of a detailed portion of the running tool in wellhead housing of FIG. 4.

Shown in FIG. 5 is a side sectional view of an example embodiment of a lead block assembly 24 engaging the inner surface of a wellhead housing 40. In this example, the piston 34 is shown urged radially outward from the axis of the running tool $A_X$ (FIG. 1) so that the malleable lead element 32A can be pressed against the inner surface of the wellhead assembly 40. A sufficient pressing force applied by the lead block assembly 24 can deform the lead element 32A and create an impression on the outer terminal end of the lead element 32A. In the example of FIG. 5, the lead block assembly 24 is substantially aligned with the groove 48, so that the impression 50 taken is of the groove 48. In the example of FIG. 5, hydraulic pressure is provided through hydraulic line 26 into the bore 28 for urging the piston 34 radially outward to force the lead block 32A against the inner surface of the wellhead housing 40. Moving the piston 34 radially outward from its position of FIG. 2 deforms the spring 36 into a compressed spring 36A shown between the closed end of the piston 34 and the lip 37. Thus, when hydraulic pressure is removed from the hydraulic line 26, the potential energy stored in the compressed spring 36A can return the piston 34 to its position of FIG. 2 so that the running tool 10 may be removed from within the wellhead housing 40.

In one example of operation, the running tool 10 is lowered on drill pipe 52 (FIG. 3) and inserted into a wellhead housing 40. The casing hanger 14 is landed within the wellhead housing 40 and the deployment mechanism 16 uncoupled from the casing hanger 14 thereby leaving the casing hanger 14 within the wellhead housing 40. The ram assembly 22 can then be actuated to stroke the insertion ram 23 and axially lower the seal assembly 18 and energizing ring 20 into an annular space formed between the outer surface of the casing hanger 14 and inner surface of the wellhead housing 40. Further actuation of the ram assembly 22 urges the energizing ring 20 between legs of the seal assembly 18 to widen the seal assembly 18 and pressure seal between the casing hanger 14 and wellhead assembly 40. In an example embodiment, the pressure seal is tested after being set. After pressure testing hydraulic pressure may be supplied through the hydraulic line 26 so that an impression 50 may be taken of the portion of the wellhead housing 40 inner surface adjacent one or more lead block assemblies 24. The hydraulic line 26 may be part of a hydraulic circuit used for operating the ram assembly 22.

After obtaining an impression 50, the running tool 10 can be removed from within the wellhead housing 40 so that the impressions 50 may be analyzed for assessing whether or not the casing hanger 14 is at a proper axial elevation within the wellhead housing 40. In one example embodiment of use of the running tool 10, the lead block assembly 24 is strategically positioned an axial distance from the casing hanger 14 so that the lead element 32 contacts the groove 48 when the casing hanger 14 is at its design or specified elevation in the wellhead housing 40. Accordingly, if the impression 50 reflects contact with the groove 48, casing hanger 14 alignment within the wellhead housing 40 (FIG. 4) can be verified. Conversely, if the impression 50 does not reflect contact with the groove 48, casing hanger 14 misalignment may be indicated. In an example, when analysis of an impression 50 taken on the lead elements 32A indicate casing hanger 14 misalignment, an undesired placement of the casing hanger 14, or in an undesignated location, the running tool 10 can be reinserted within the wellhead housing 40 for repositioning the casing hanger 14 within the wellhead housing 40.

Strategically positioning the lead block assembly 24 within the body 25 can set the lead block assembly 24 at a relative distance between the casing hanger 14 and groove 48 so that analyzing the impression 50 of a strategically positioned lead block assembly 24 indicates whether or not the casing hanger 14 is set at a designated depth within the wellhead housing. For the purposes of discussion herein, a designated depth describes a depth wherein the casing hanger 14 is designed and/or otherwise desired to be set within the wellhead housing 40. Accordingly, verification of the casing hanger 14 at a designated axial location within the wellhead housing 40 can be obtained without the need for pressure testing within the wellhead housing 40. As such, an operational step can be avoided by use of the running tool in casing hanger as disclosed herein.

Figure 6:
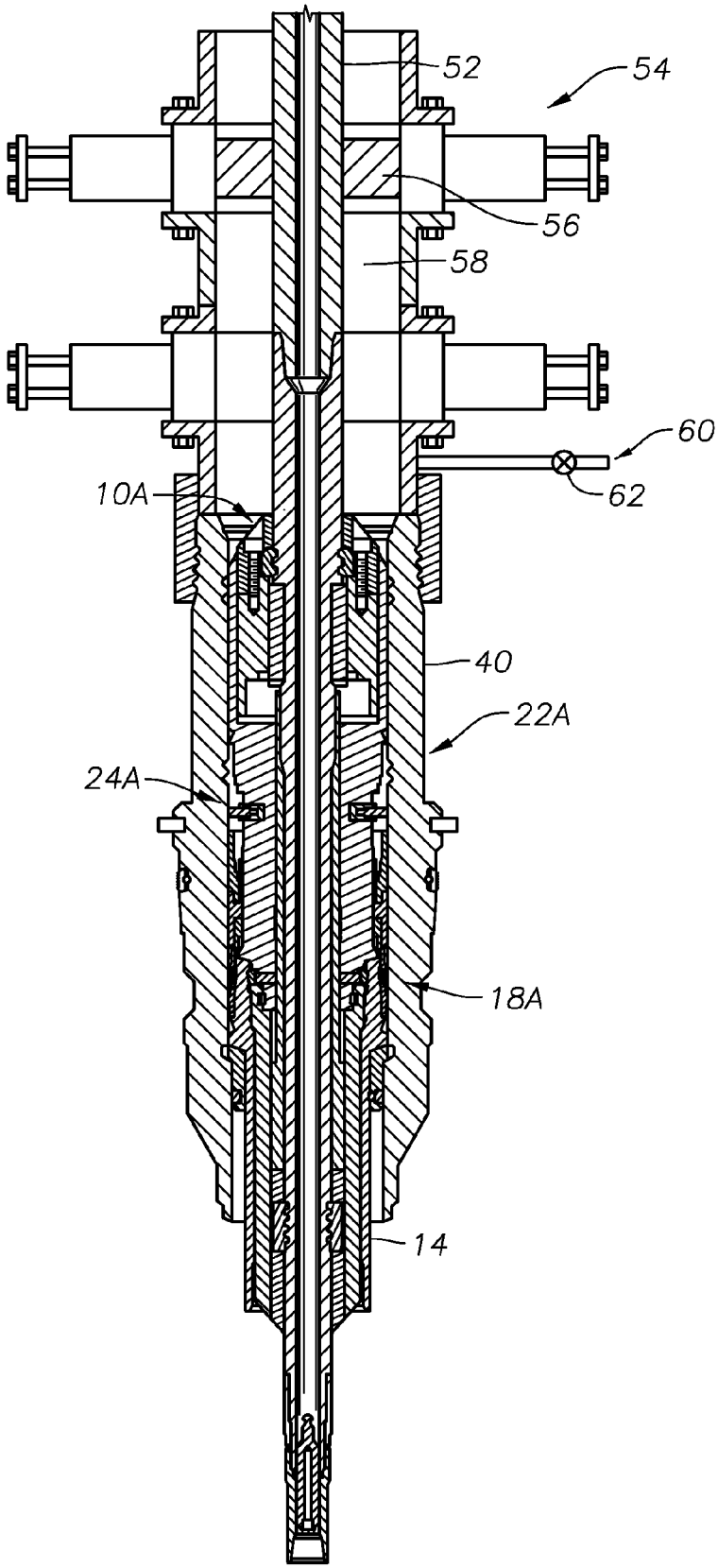
FIG. 6 is a side sectional view of the running tool of FIG. 4 and a blow out preventer mounted on the wellhead housing.

Optionally, as shown in a side partial sectional view in FIG. 6, an embodiment of the running tool 10A may be operated in conjunction with a blow out preventer (BOP) 54. In the example embodiment of FIG. 6, rams 56 from the BOP 54 are shown deployed radially inward into sealing contact with the outer surface of the drill pipe 52. Sealingly engaging the rams 56 with the drill pipe 52 creates a sealed space 58 within the BOP 54 and wellhead housing 40 above the running tool 10A. In an alternate example of use, the space 58 can be pressurized to exert a force onto the running tool 10A. When a sufficient force is created in the space 58, the ram assembly 22A is urged downward to insert and set the seal assembly 18A between the casing hanger 14 and wellhead housing 40. Additionally, a resultant force by pressurizing the space 58 can be used to obtain an impression using the impression block assembly 24A. A line 60 with a valve 62 is shown connected to the BOP 54 that can selectively deliver pressurized fluid to the space 58 for forcing the running tool 10A downward and setting the energizing ring into the seal. In an example, the line 60 connects to choke and kill lines (not shown) having pressurized fluid therein.

While the invention has been shown or described in only some of its forms, it should be apparent to those skilled in the art that it is not so limited, but is susceptible to various changes without departing from the scope of the invention.

What is claimed is:

1. A running tool for inserting a support hanger into a wellhead housing that has a profiled inner surface, the running tool comprising:

a body;

a support hanger deployment device coupled with the body to be selectively attached to the support hanger; and an impression assembly coupled to the support hanger, the impression assembly comprising:

a member that is selectively moveable from a retracted position substantially within the body to an extended position projecting radially outward from the body towards the wellhead housing inner surface, and a deformable impression element provided on an end of the member, so that when the member is moved into the extended position, the impression element is pressed against the wellhead housing inner surface and an impression of the wellhead housing inner surface is on the impression element.

2. The running tool of claim 1, wherein the body has a shoulder for energizing an upper end of the support hanger and the impression assembly is mounted to the body at a selected axial distance from the shoulder.

3. The running tool of claim 1, wherein the strategic positioning places the impression assembly in a location so that the impression is of the profiled inner surface of the wellhead housing when the support hanger is set at a designated depth within the wellhead housing.

4. The running tool of claim 1, wherein the impression assembly comprises a first impression assembly, the running tool further comprising a second impression assembly strategically disposed a distance away from the first impression assembly along an axis of the running tool.

5. The running tool of claim 1, wherein the impression assembly further comprises a radially extending bore in the body having an open end and a closed end, a piston axially movable within the bore, a spring biasing the piston against the closed end of the bore, an impression rod having an end coupled with the piston and a distal end connected to the impression element.

6. The running tool of claim 1, further comprising a seal deployment assembly mounted to the body for setting a seal between the support hanger and the wellhead housing.

7. The running tool of claim 6, wherein the impression assembly is disposed between the seal deployment assembly and the support hanger deployment device.

8. A method of landing a support hanger in a wellhead housing having an inner surface with a profiled portion, the method comprising:

(a) providing a profiled portion in an inner surface of the wellhead housing;

(b) providing a running tool having a body, a support hanger coupled with the body, and a selectively extendable impression block strategically located at a position on the running coupled with the body;

(c) inserting the running tool with the support hanger into the wellhead housing;

(d) landing the support hanger in the wellhead housing;

(e) forming an impression of the profiled portion of the wellhead housing on the impression block by extending the impression block radially outward and into contact with the profiled portion of the wellhead housing; and (f) establishing a location of the support hanger within the wellhead based on the impression of the profiled portion.

9. The method of claim 8, further comprising removing the running tool from the wellhead housing prior to step (f) and visually inspecting the impression block.

10. The method of claim 8, wherein the impression block is strategically located so that when the impression block contacts the profiled portion and provides an image of the profiled portion onto the impression block, when the support hanger is landed at a designated location.

11. The method of claim 10, further comprising setting a seal between the support hanger and wellhead housing.

12. The method of claim 8, further comprising removing the running tool from the wellhead housing prior to step (f), inspecting the impression block, and when an image of the profiled portion is not on the impression block, determining that the support hanger is away from the designated location, and reinserting the running tool into the wellhead housing to reposition the support hanger to the designated position.

13. The method of claim 8, wherein the impression block comprises a first impression block and the position comprises a first position, wherein step (a) further comprises a second selectively extendable impression block strategically located at a second position on the running tool.

14. The method of claim 13, wherein the second position is set apart from the first position by a distance along an axis of the running tool.

15. The method of claim 8, wherein step (a) comprises forming a circumferential groove in the inner surface.

16. The method of claim 15, wherein step (f) is performed prior to pressure testing between the wellhead housing and the support hanger.

17. A method of landing a support hanger in a wellhead housing, the method comprising:

(a) providing a profiled portion in an inner surface of the wellhead housing;

(b) providing a running tool having an attached support hanger and a selectively extendable impression block strategically located at a position on the running tool;

(c) inserting the running tool with the support hanger into the wellhead housing;

(d) landing the support hanger in the wellhead housing;

(e) setting a seal between the support hanger and the wellhead housing; and (f) during the same trip to the wellhead housing as steps (a)-(e), forming an impression of the profiled portion of the wellhead housing on the impression block by extending the impression block radially outward and into contact with the profiled portion of the wellhead housing so that the location in the wellhead housing where the support hanger is landed can be established based on the impression of the profiled portion.

18. The method of claim 17, wherein step (e) occurs prior to step (f).

19. The method of claim 17, further comprising removing the running tool from the wellhead housing and visually inspecting the impression block prior to estimating the location in the wellhead housing where the support hanger is landed.

20. The method of claim 17, wherein the impression block is strategically located so that when the impression block contacts the profiled portion and provides an image of the profiled portion onto the impression block, when the support hanger is landed at a designated location.

21. The method of claim 17, wherein a blow out preventer is set on the wellhead housing, the method further comprising forming a sealed space above the running tool by deploying rams in the blow out preventer and performing steps (d), (e), and (f) by pressurizing the space.

22. A wellhead assembly comprising:

a wellhead housing;

a support hanger coaxially landed in the housing;

a profile on an inner circumference of the support hanger;

a running tool inserted within the casing hanger having an impression assembly with a deformable impression element that is selectively moveable from the running tool and to the inner circumference of the support hanger, so that when the deformable impression element contacts the profile, an impression of the profile is made on the deformable impression element thereby establishing a location of the support hanger.

23. The wellhead assembly of claim 22, wherein the support hanger comprises a casing hanger.

* * * * *